US009505219B2

(12) United States Patent
Gilliam

(10) Patent No.: US 9,505,219 B2
(45) Date of Patent: Nov. 29, 2016

(54) DROPLET EJECTION APPARATUS AND METHOD OF CLEANING THE SAME

(71) Applicant: OCE-TECHNOLOGIES B.V., Venlo (NL)

(72) Inventor: Richard Gilliam, Venlo (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 14/980,942

(22) Filed: Dec. 28, 2015

(65) Prior Publication Data

US 2016/0200107 A1 Jul. 14, 2016

Related U.S. Application Data

(60) Provisional application No. 62/101,559, filed on Jan. 9, 2015.

(30) Foreign Application Priority Data

Apr. 7, 2015 (EP) ..... 15162573

(51) Int. Cl.
*B41J 2/165* (2006.01)
*B41J 2/17* (2006.01)

(52) U.S. Cl.
CPC ..... *B41J 2/16552* (2013.01); *B41J 2/165* (2013.01); *B41J 2/1714* (2013.01); *B41J 2002/16502* (2013.01); *B41J 2002/16564* (2013.01)

(58) Field of Classification Search
CPC .... B41J 2/165; B41J 2/1714; B41J 2/16552; B41J 2002/16502
See application file for complete search history.

(56) References Cited

U.S. PATENT DOCUMENTS 5,307,093 A * 4/1994 Suzuki ..... B41J 2/04528 347/17
6,660,103 B1 12/2003 Johnston et al.
8,136,909 B2 3/2012 Ogasawara et al.
2007/0103512 A1* 5/2007 Miura ..... G02B 27/0006 347/47

FOREIGN PATENT DOCUMENTS

EP 1284184 A2 2/2003
JP 2008-161751 A 7/2008
JP 4843369 B2 12/2011

* cited by examiner

*Primary Examiner* — Manish S Shah
*Assistant Examiner* — Yaovi M Ameh
(74) *Attorney, Agent, or Firm* — Birch, Stewart, Kolasch & Birch, LLP

(57) ABSTRACT

A droplet ejection apparatus includes: a number of droplet ejection units each of which has a nozzle connected to a liquid chamber and an actuator for expelling droplets of a process liquid; a cleaning station; and a control system arranged to control a relative movement of the droplet ejection units and the cleaning station and to immerse the nozzles into a cleaning liquid, wherein a heater is provided for heating the droplet ejection units, and the control system is adapted to activate the heater when the droplet ejection units and the cleaning station are moved or have been moved towards one another, and to deactivate the heater to allow the droplet ejection units to cool down while the nozzles are immersed in the cleaning liquid.

8 Claims, 2 Drawing Sheets

DROPLET EJECTION APPARATUS AND METHOD OF CLEANING THE SAME

CROSS REFERENCE TO RELATED APPLICATIONS

Figure 1:
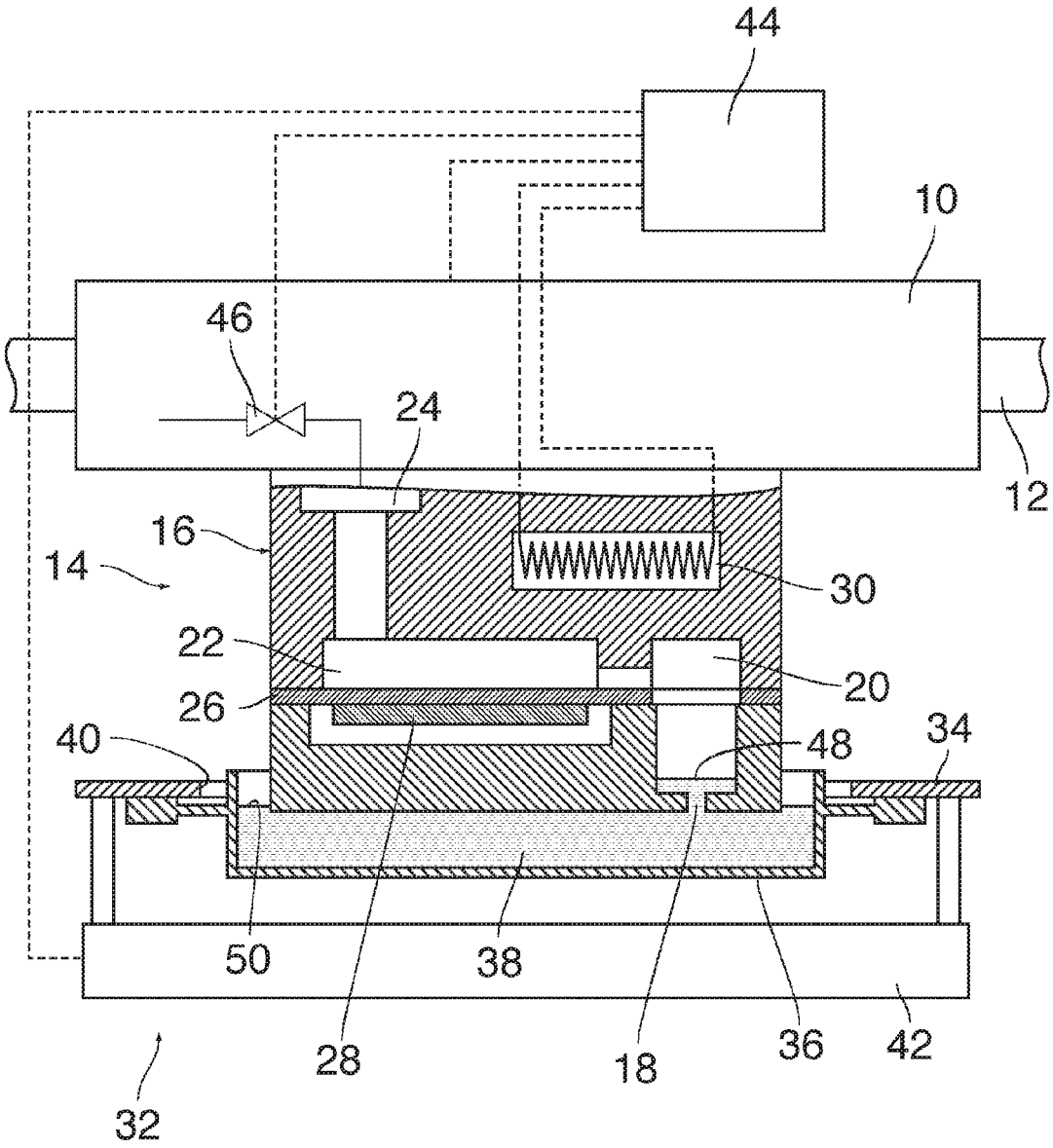

This non-provisional application claims the benefit under 35 U.S.C. §119(e) to U.S. Provisional Application No. 62/101,559, filed on Jan. 9, 2015, and under 35 U.S.C. §119(a) to Patent Application No. 15162573.8, filed in Europe on Apr. 7, 2015, all of which are hereby expressly incorporated by reference into the present application.

The invention relates to a droplet ejection apparatus comprising: a number of droplet ejection units each of which has a nozzle connected to a liquid chamber and an actuator for expelling droplets of a process liquid; a cleaning station; and a control system arranged to control a relative movement of the droplet ejection units and the cleaning station and to immerse the nozzles into a cleaning liquid.

The invention further relates to a method of cleaning such a droplet ejection apparatus.

As an example of a droplet ejection apparatus of this type, U.S. Pat. No. 6,660,103 B1 discloses an ink jet printer wherein droplets of the process liquid, i.e. an ink, are expelled from the nozzles in order to print an image on a recording medium. Since the ink tends to dry and to clog the nozzles when the printer is not in use, it is necessary to clean the nozzles from time to time.

The known cleaning method consists of moving the droplet ejection units to the cleaning station that comprises a basin containing a volume of the cleaning liquid and then to immerse the nozzles into the cleaning liquid. Capillary forces will cause the cleaning liquid to enter into the nozzles which are thereby soaked with the cleaning liquid. Then, the cleaning liquid is removed again by flushing the nozzles with air.

It is an object of the invention to offer a simple and more efficient way of cleaning the nozzles.

In order to achieve this object, the droplet ejection apparatus according to the invention is characterized in that a heater is provided for heating the droplet ejection units, and the control system is adapted to activate the heater when the droplet ejection units and the cleaning station are moved or have been moved towards one another, and to deactivate the heater to allow the droplet ejection units to cool down while the nozzles are immersed in the cleaning liquid.

Accordingly, the cleaning method according to the invention comprises the steps of heating the droplet ejection units, moving the droplet ejection units and the cleaning station towards one another and immersing the nozzles into the cleaning liquid, and then allowing the droplet ejection units to cool down while the nozzles are immersed in the cleaning liquid.

When the droplet ejection units are allowed to cool down while the nozzles are immersed in the cleaning liquid, the medium that fills the liquid chambers will shrink in volume, thereby creating a suction pressure that helps to actively draw-in the cleaning liquid into the nozzles. This permits the cleaning process to be more efficient because the cleaning liquid flows through the nozzles with increased velocity and is also allowed to penetrate deeper into the liquid chambers, so that the cleaning liquid in the liquid chambers can reach a level that is higher than the level of the cleaning liquid in the basin outside of the droplet ejection units. Moreover, at least in the initial phase of the cleaning process, the elevated temperature will also help to clean the nozzles more efficiently because a part of the residual heat will be transferred to the cleaning liquid and the increased temperature of the cleaning liquid promotes the dissolution of contaminants.

More specific optional features and further developments of the invention are indicated in the dependent claims.

In the method according to the invention, the heater is preferably activated at the time when the droplet ejection units, which may be mounted on a carriage, start to move towards the cleaning station, so that the travel time of the carriage can be utilized for heating. This, however, is not compulsory. It is also possible to start heating only after the carriage has reached the cleaning station. On the other hand, the heater may be activated already before the carriage starts to move towards the cleaning station.

Depending upon the type of droplet ejection apparatus to which the invention is applied, the heater may also be used for keeping the process liquid at a suitable temperature during the droplet ejection process. For example, some ink jet printers and 3D-printers utilize inks that form a gel or are even a solid at room temperature and therefore need to be heated in order to keep them in the liquid state. These apparatus are equipped with a heater, anyway, and the same heater may conveniently be used for the cleaning process according to the invention. It is particularly convenient to perform the cleaning process immediately after a phase in which the printer has been operating, so that the liquid chambers and the ink contained therein are already at an elevated temperature when the carriage is moved to the cleaning station.

When the nozzles are immersed in the cleaning liquid and the cleaning liquid has been drawn-in due to the decreasing temperature of the medium the liquid chambers, the cleaning liquid may easily be removed from the liquid chambers and the nozzles by heating the droplet ejection units again. In comparison to flushing the nozzles with air, this has the advantage that it reduces the risk of air bubbles being trapped in the process liquid. In an ink jet printer, for example, such air bubbles could disturb the process of droplet formation and ejection.

While the nozzles are immersed in the cleaning liquid, it is also possible to perform several cycles of heating and cooling, so that the cleaning liquid is alternatingly drawn in and pushed out, and a particularly intense cleaning action is achieved.

In the droplet ejection apparatus according to the invention, the control system may be arranged to activate and deactivate the heater simply by providing a manually operated switch for switching the heater on and off. In a preferred embodiment, however, an electronic control system is programmed to control the heater automatically when a command to start a cleaning process is entered or is generated automatically when the droplet ejection process stops.

Figure 2:
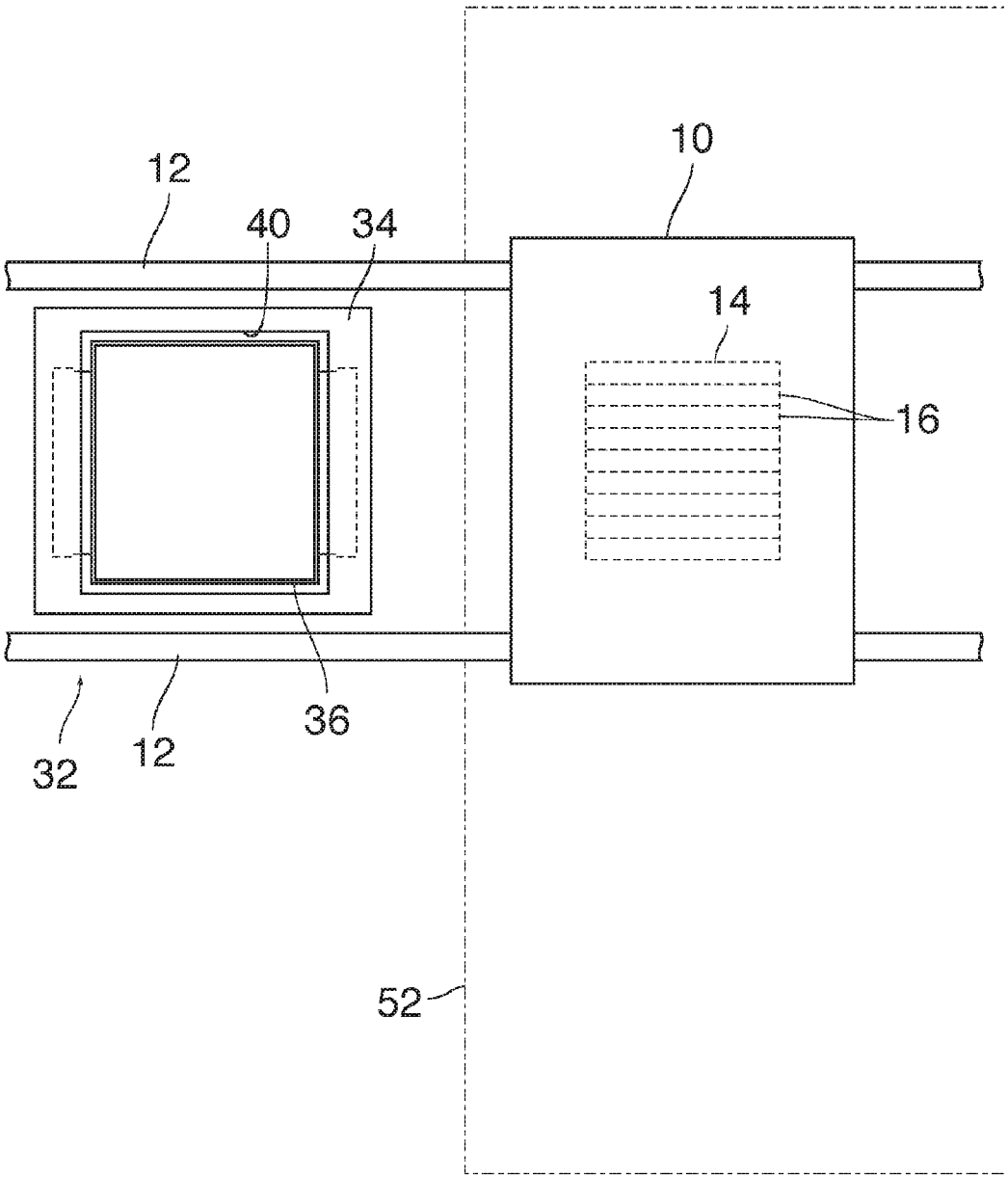

Embodiment examples will now be described in conjunction with the drawings, wherein:

FIG. 1 is a schematic cross-sectional view of a droplet ejection apparatus with a cleaning station according to the invention; and FIG. 2 is a schematic top plan view showing a carriage of the droplet ejection apparatus in a position remote from the cleaning station.

As a representative example of a droplet ejection apparatus, FIG. 1 shows an ink jet printer having a carriage 10 that is movable along guide rails 12. A print head 14 is mounted on the bottom side of the carriage 10 and comprises a plurality of droplet ejection units 16 arranged in a row that extends at right angles to the guide rails 12, in the direction normal to the plane of the drawing in FIG. 1.

A single one of the droplet ejection units 16 has been shown in section in FIG. 1. This unit has a downwardly facing nozzle 18 that is connected to a liquid chamber 20 and further to a pressure chamber 22 and an ink supply system 24. The pressure chamber 22 is bounded on the bottom side by a flexible membrane 26 to which a piezoelectric actuator 28 is attached.

When the droplet ejection unit 16 is operating, liquid ink is supplied from the ink supply system 24 into the pressure chamber 22. A voltage pulse applied to the actuator 28 causes the actuator and the flexible membrane 26 to flex, thereby to change the volume of the pressure chamber 22, so that an acoustic pressure wave is excited in the liquid ink. This pressure wave propagates into the liquid chamber 20 and causes an ink droplet to be expelled from the nozzle 18.

A heater 30 is provided in the print head for heating the droplet ejection units 16 and, in particular, the liquid chambers 20 and the liquid ink contained therein.

In the situation illustrated in FIG. 1, the carriage 10 has been moved into a position above a cleaning station 32 that comprises a carrier plate 34. A basin 36 that contains a cleaning liquid 38 is attached to a bottom face of the carrier plate 34. The top side of the basin 36 is open and projects through a window 40 of the carrier plate 34.

The carrier plate 34 is supported on a lifting device 42 and, in the condition shown in FIG. 1, has been lifted to such a height that the mouth of the nozzle 18 is just immersed in the cleaning liquid 38.

An electronic control system 44 is provided for controlling the movements of the carriage 10 (via a drive system that has not been shown) as well as the operation of the lifting device 42 and the heater 30. In the example shown, the ink supply system 24 includes an electronic cut-off valve 46 that is also controlled by the control unit 44.

When, in the situation shown in FIG. 1, the heater 30 is switched off by the control unit 44 and the cut-off valve 46 is closed, the print head 14 and the liquid ink contained therein are allowed to cool down to room temperature, with the result that the volume of the liquid ink shrinks. Since the cut-off valve 46 prevents the pressure chamber 22 and the liquid chamber 20 from being vented, a sub-atmospheric pressure (suction pressure) is generated in the liquid chamber 20. As a consequence, some of the cleaning liquid 38 is drawn-in through the nozzle 18 and rises into the liquid chamber 20 to a level 48 that is higher than the level 50 of the cleaning liquid outside of the print head. In this way, the nozzle 18 and at least the lower part of the liquid chamber 20 are efficiently flushed with the cleaning liquid 38. A particularly high cleaning effect is achieved because the flow direction of the cleaning liquid in the nozzle 18 is opposite to the flow direction of the ink during a printing operation (reverse flush) and because the temperature of the cleaning liquid in the nozzle and the ink chamber is elevated above room temperature by the residual heat that is still stored in the bulk material of the print head, even though the heater 30 has been switched off. The elevated temperature of the cleaning liquid has the effect that any contaminants in the nozzle 18 and the liquid chamber 20 can be dissolved more efficiently.

In a practical embodiment, the heater 30 may have heated the print head 14 to an initial temperature in a range from 70 to 140° C., for example. When the heater is switched off, the temperature will decrease, e.g. at a rate of 20° C. per hour.

When the print head has cooled down to a certain temperature level, the heater 30 may be switched on again so as to re-heat the ink in the liquid chamber 20, and the thermal expansion of the ink will result in the cleaning liquid 38 being squeezed out again. These processes may be repeated in several cycles for thoroughly cleaning the nozzles 18. Conveniently, the cleaning process may be performed automatically when the printer is not in use, e.g. over night.

In order to finish the cleaning process, the heater 30 may be switched on, so that the print head is heated to a temperature at which the cleaning liquid 38 is completely squeezed out of the liquid chamber 20 and the nozzle 18. Then, the carrier plate 34 will be lowered by suitably controlling the lifting device 42, so that the lower face of the print head 14 is drawn out of the basin 36 and is then free to move with the carriage 10 along the guide rails 12, so that the printing operation can be resumed.

In a useful embodiment, the printer uses a gelling-type UV-curable ink that forms a gel at room temperature. In that case, the heater 30 is also used for keeping the ink at an elevated temperature and, consequently, in the liquid state during the printing operation. Then, when the printing operation is finished and the carriage 10 is moved into the position shown in FIG. 1 in order to start another cleaning process, the heater 30 is switched off, and the ink cools down. At a certain temperature which is still significantly higher than room temperature, the liquid ink starts gelling in the liquid chamber 20, the pressure chamber 22 and the connected ink supply system, so that the pressure chamber 22 is prevented from being vented via the ink supply system 24 because the gel blocks the entry of air. Consequently, the cut-off valve 46 may be dispensed with in this case.

In another embodiment, the liquid ink may be drained from the liquid chamber 20 and the pressure chamber 22 via the ink supply system 24 when the printing operation has stopped and a cleaning operation is to start. In that case, it will be the thermal contraction and expansion of the air in the pressure chamber 22 and the liquid chamber 20 that causes the cleaning liquid 38 to be sucked in and squeezed out.

FIG. 2 illustrates a situation where the carriage 10 has been moved away from the cleaning station 22 and into an operating range above a platen 52 for supporting a recording medium (not shown) on which an image is to be formed with the print head 14 as is well known in the art. It should be noted that the drawings are not to scale and that, in practice, the number of droplet ejecting units 16 of the print head may be significantly larger than has been shown here. The units 16 may also be disposed in several parallel rows, e.g. one for each of a number of different colours.

While, in the shown example, the carrier plate 34 in the cleaning station 32 can be lifted and lowered with the lifting device 42, it is possible in another embodiment that the basin 36 in the cleaning station 32 is stationary and the print heat 14 or the entire carriage 10 is adapted to be lifted and lowered in order to immerse the nozzles into the cleaning liquid. In yet another design, the print head may be stationary and the cleanings station may be moved towards the print head in order to start a cleaning operation.

The invention claimed is:

1. A droplet ejection apparatus comprising: a number of droplet ejection units each of which has a nozzle connected to a liquid chamber and an actuator for expelling droplets of a process liquid; a cleaning station; and a control system configured to control a relative movement of the droplet ejection units and the cleaning station and to immerse the nozzles into a cleaning liquid, wherein a heater is provided for heating the droplet ejection units, and the control system is further configured to activate the heater when the droplet ejection units and the cleaning station are moved or have been moved towards one another, and to deactivate the heater to allow the droplet ejection units to cool down while the nozzles are immersed in the cleaning liquid.

2. The apparatus according claim 1, wherein the droplet ejection units are mounted on a movable carriage.

3. The apparatus according claim 1, configured as an ink jet printer with a print head having the droplet ejection units.

4. The apparatus according to claim 1, wherein the droplet ejection units are configured for operation with a process liquid that is solid or forms a gel at room temperature.

5. The apparatus according claim 1, wherein the cleaning station comprises an upwardly open basin that contains the cleaning liquid, and a lift mechanism is provided for lifting and lowering the droplet ejection units and the basin relative to one another for immersing the nozzles into the cleaning liquid.

6. A method of cleaning a droplet ejection apparatus that comprises a number of droplet ejection units each of which has a nozzle connected to a liquid chamber and an actuator for expelling droplets of a process liquid, and a cleaning station that stores a cleaning liquid, wherein the method comprises the steps of:

heating the droplet ejection units to an elevated temperature that is higher than room temperature when the droplet ejection units and the cleaning station are moved or have been moved towards one another;

immersing the nozzles into the cleaning liquid; and allowing the droplet ejection units to cool down while the nozzles are still immersed in the cleaning liquid.

7. The method according to claim 6, comprising a subsequent step of re-heating the droplet ejection units for squeezing the cleaning liquid out of the nozzles though thermal expansion of a medium that is contained in the liquid chambers.

8. The method according to claim 7, comprising several cycles of heating and cooling the droplet ejection units.

* * * * *